United States Patent [19]
Rath

[11] 4,254,564
[45] Mar. 10, 1981

[54] REVERSIBLE SNOWPLOW ATTACHMENT

[75] Inventor: Albert Rath, Kitchener, Canada

[73] Assignee: C.E.P. Industries Limited, Toronto, Canada

[21] Appl. No.: 71,367

[22] Filed: Aug. 30, 1979

[51] Int. Cl.³ ..... E01H 5/00
[52] U.S. Cl. ..... 37/42 VL; 37/50
[58] Field of Search ..... 37/41, 42 R, 42 VL, 37/50, 29, 35, 43 R

[56] References Cited

U.S. PATENT DOCUMENTS

| | | | |
|---|---|---|---|
| 2,061,585 | 11/1936 | Meyer | 37/42 R |
| 2,085,996 | 7/1937 | Phillips | 37/42 R |
| 3,466,767 | 9/1969 | Rubin | 37/43 R |
| 3,712,383 | 1/1973 | Renahan | 37/42 VL X |
| 3,762,077 | 10/1973 | Henry | 37/41 |

FOREIGN PATENT DOCUMENTS

| | | | |
|---|---|---|---|
| 747609 | 12/1966 | Canada | 37/43 R |

*Primary Examiner*—E. H. Eickholt
*Attorney, Agent, or Firm*—Ridout & Maybee

[57] ABSTRACT

In a snowplow of the type having a forwardly mounted plowblade which is reversible for left hand or right hand operation, the plowblade is a composite assembly of blade members comprising a fixedly mounted scoop blade and a deflector pivotally mounted so as to be tiltable about an axis perpendicular to the scoop blade. Hydraulic cylinders for tilting the deflector about its axis are cooperatively coupled to a pair of hydraulic cylinders for rotating the plowblade between its left hand and right hand operative positions, the hydraulic connections being such that when either end of the plowblade is brought to a trailing position the corresponding end of the deflector is raised.

8 Claims, 5 Drawing Figures

REVERSIBLE SNOWPLOW ATTACHMENT

This invention relates to snowplows and snowplow attachments for tractors and like propelling vehicles. More particularly, the invention relates to snowplows of the type designed for high speed operation, typically 20 m.p.h. or higher, and having a forwardly mounted plowblade which is set obliquely to the forward direction of travel and configured so that during forward travel snow is scooped upwardly and deflected laterally across the face of the blade towards its trailing end. The angular setting of the blade determines the lateral direction in which snow is cast from the blade.

From the viewpoint of operating efficiency the configuration of the blade is important for the blade configuration affects both the distance the snow is cast laterally and the load on the vehicle. In general, for optimum operating efficiency, the blade has a concave front face with a horizontal bottom edge and a top edge which diverges upwardly from the bottom edge towards the trailing end of the blade. In this case the effective height of the blade increases progressively, usually linearly, across the width of the blade in the direction in which the snow is deflected. Such a configuration assists the lifting action of the blade and reduces the tendency for snow to accumulate in front of the blade as it is deflected and thereby impede the snowplow. However, conventional plowblades of this type are adapted to cast snow in one direction only, either to the left or to the right, during travel of the vehicle, since the blade configuration determines the position at which the blade must be set obliquely to the direction of travel. For some applications it is desirable that the snowplow blade should be reversible for left hand or right hand operation, and indeed reversible blades which can be mounted at two oblique settings so as to bring either end of the blade into the trailing position are known. The disadvantage with such snowplow blades, however, is that their construction generally requires a blade configuration which is not the best configuration from the viewpoint of operating efficiency.

It is one object of the present invention to provide a snowplow blade construction which overcomes this disadvantage. This object is achieved, essentially, by providing a blade which is a composite structure comprising a lower, fixedly mounted scoop blade portion and an upper blade portion, or deflector, which is positioned to recieve snow lifted by the scoop blade portion, the upper portion being tiltable about an axis normal to the scoop blade portion for bringing either end into a raised position.

Thus, according to one aspect of the invention, a snowplow having a forwardly mounted blade configured to scoop snow from the path of the snowplow and cast the snow laterally therefrom, the blade being angled to the forward direction so that during forward movement it scoops snow upwardly and laterally across a front face of the blade towards its trailing end, the blade being pivotally mounted on the plow for pivotal movement about a vertical axis for reversing the direction in which the snow is cast, is characterized in that the blade is a composite structure comprising a fixedly mounted scoop blade portion and a deflector portion positioned to intercept snow lifted thereby, the deflector being pivotally mounted for movement about an axis perpendicular to the scoop blade portion and tiltable relative to the scoop blade portion about said axis for raising either end with respect to the other end.

In a preferred embodiment of the invention the composite blade and the deflector thereof are moved about their respective axes by respective power means, such as hydraulic cylinders for example, which are cooperatively coupled so that when either end of the blade is moved to a trailing position the corresponding end of the deflector is moved to the raised position.

According to another aspect of the invention there is provided a snowplow attachment for a vehicle having a frontal support therefor, comprising: a boom structure extending forwardly from the frontal support, a transverse frame pivotally connected to the forward end of the boom structure for pivotal movement about a vertical axis, a composite blade assembly mounted on and extending along the frame, said blade assembly being configured to scoop snow to be cleared from the path of the snowplow and to cast the snow laterally, first power means connected between the transverse frame and the frontal support for turning the frame in either direction about said axis between respective positions in which the opposite ends of the blade assembly are respectively leading and trailing with respect to the forward direction, the blade assembly comprising a fixedly mounted scoop blade portion extending for the full length thereof and a deflector positioned to intercept snow lifted by the scoop blade portion, the deflector being pivotally mounted on the frame for pivotal movement about an axis perpendicular to the scoop blade portion, and second power means connected between the frame and the deflector for tilting the latter about said axis.

In order that the invention may be readily understood, one preferred embodiment thereof will now be described by way of example with reference to the accompanying drawings, in which:

FIG. 1 is a perspective view, from the rear, of a snowplow attachment in accordance with the invention;

FIG. 1*a* shows a detail of FIG. 1 with certain parts removed to show structure which is hidden in FIG. 1;

Figures 1, 1A:
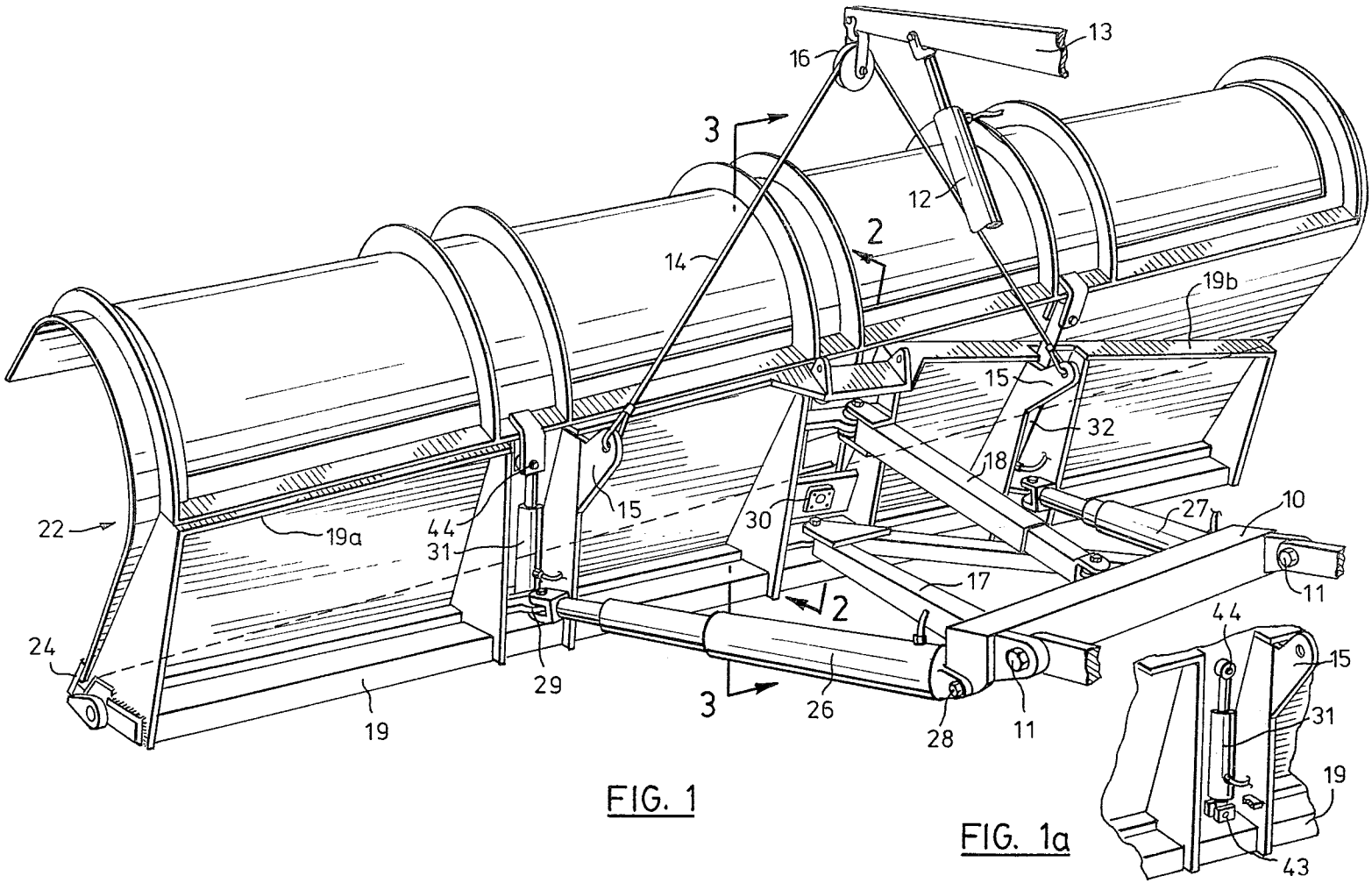

Referring to the drawings, FIG. 1 shows the snowplow attachment mounted on a tractor having a frontal support 10 provided for the purpose. The support 10 is connected to the tractor by hinges 11, so that the snowplow attachment can be raised and lowered, in the conventional manner, by a hydraulic cylinder 12 acting on an arm 13, the attachment being suspended from the forward end of the arm by a cable 14 connected to the lugs 15 and passing over a pulley 16. A boom structure consisting of a V-frame 17 and an upper beam 18 extends forwardly from the support 10, and a transverse frame 19 is pivotally connected, at a position midway between its ends, to the forward end of the boom structure by universal pivots 20, 21. The frame is thus mounted for pivotal movement about a substantially vertical axis. A snowplow blade 22 is mounted on the frame, extending along its full length. The snowplow blade 22 has a forwardly directed front face which, so far as it is concavely curved to scoop snow from the path of the snowplow and deflect the snow laterally according to the angular setting of the blade is, conventional. However, as will be described in greater detail, the blade of the present invention is a composite assembly of blade portions which are movable relative to one another. Thus, the blade assembly comprises a scoop blade portion 23 which is fixedly mounted on the transverse frame 19, the scoop blade portion having a scraper blade 24 extending along its bottom edge, and a deflector 25 which, in operation of the snowplow, is positioned to receive snow scooped up over the front face of the blade and deflect it laterally according to the angular setting of the blade with respect to the forward direction of travel.

In order to position the snowplow blade so that it will cast snow to the left of the snowplow in operation, it is necessary to rotate the transverse frame 19 about its vertical pivotal axis to bring the left hand end of the blade assembly to a trailing position and the right hand end to a leading position. Similarly, in order to position the snowplow blade for casting snow to the right, it is necessary to rotate the frame about its pivotal axis in the opposite direction. For effecting this rotary movement of the transverse frame 19, and the blade assembly 22 mounted thereon, between its left hand and right hand operative positions, a pair of hydraulic cylinders 26, 27 are provided, these cylinders extending between the frontal support 10 and the frame 19 and being disposed on opposite sides of the boom structure 17, 18 at equal distances from it. Pressurized fluid for operating the hydraulic cylinders, which are respectively extended and retracted according to the required direction of movement, is conveniently supplied by a hydraulic unit mounted on the tractor. As illustrated in FIG. 1, the rear ends of the hydraulic cylinders 26, 27 are connected to the frontal support by horizontal hinges 28, and the forward ends are connected to the frame 19 by vertical hinges 29.

Referring again to the composite blade 22, the scoop blade portion 23 is mounted on the frame 19 so as to provide a space into which the lower part of the deflector 25 projects, the scoop blade portion thus overlapping the lower part of the deflector. The deflector 25 is pivotally connected to the transverse frame 19, at a position midway between its ends, by a swivel 30 defining an axis which lies perpendicular to the scoop blade portion at that position. In this way the deflector is tiltable in either direction relatively to the scoop blade portion 23 so as to bring either of its ends into a raised position.

Figure 2:
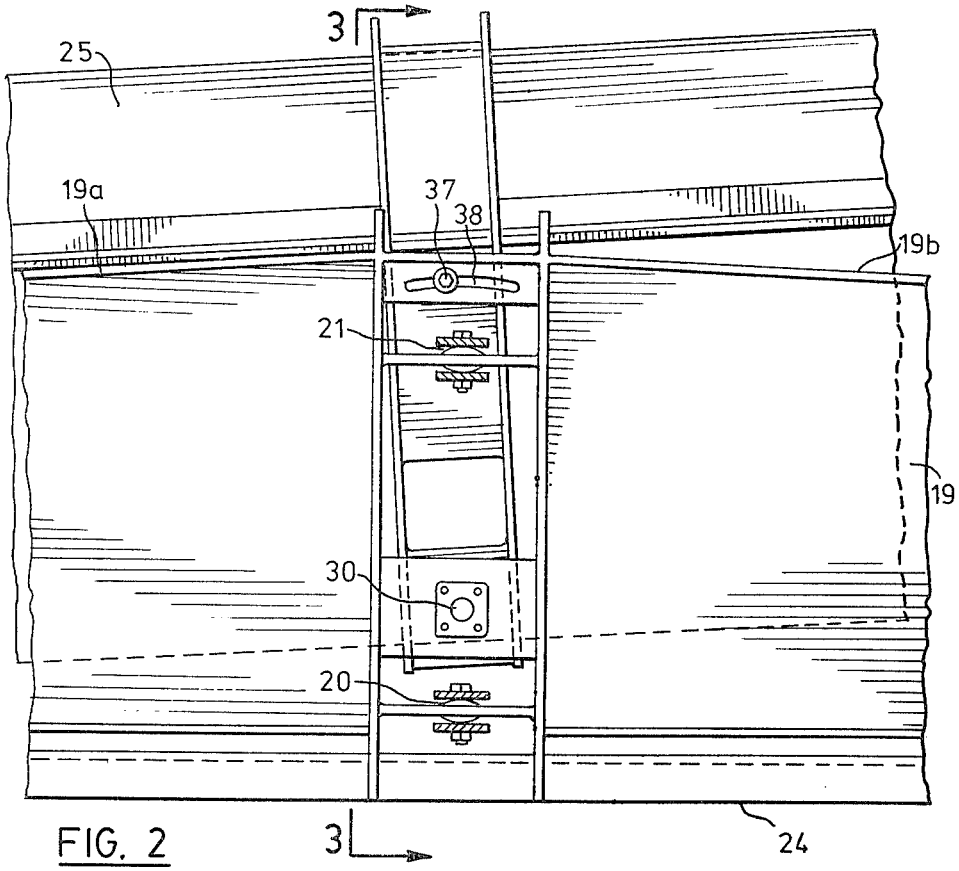
FIG. 2 is a rear elevational view of a detail of FIG. 1, viewed in the direction of the arrows 2.

As best illustrated in FIGS. 1 and 2, the top edge of the frame has a pair of downwardly and outwardly sloping flange portions 19*a*, 19*b*, which provide bearing surfaces to engage a cooperating flange 25*a* extending horizontally across the rear face of the deflector 25 according to the direction in which the deflector is tilted. A pin 37 projecting from the rear face of the deflector engages a short arcuate guide slot 38 in the frame 19, the centre of curvature of the guide slot being at the swivel 30. When either end of the deflector is so raised, the configuration of the composite blade assembly is such that its top edge is inclined to the bottom edge, the front face thereby widening progressively from one end to the other, this being a requirement for efficient operation.

In the present example such tilting of the deflector about the swivel axis is effected by a second pair of hydraulic cylinders 31, 32. These hydraulic cylinders are disposed on opposite sides of the boom structure 17, 18 at equal distances therefrom, their lower ends being connected to the frame 19 by pivots 43 (FIG. 1*a*) and their upper ends being connected to the deflector 25 by pivots 44. Pressurized fluid for operation of the hydraulic cylinders 31, 32 to bring the deflector into either of its tilted positions is conveniently supplied from the tractor. Preferably, the cylinders 26, 27 are cooperatively coupled to the cylinders 31, 32 and controlled by a suitable selector valve so that, when either end of the blade assembly is brought to the trailing position by actuation of the hydraulic cylinders 26, 27, the corresponding end of the deflector 25 is automatically tilted to the raised position by an accompanying actuation of the cylinders 31, 32. Thus, the hydraulic connections are such that extension of the cylinder 26 is always accompanied by extension of the cylinder 32 and retraction of cylinders 27 and 31, while extension of the cylinder 27 is always accompanied by extension of the cylinder 31 and retraction of cylinders 26 and 32.

Figure 4:
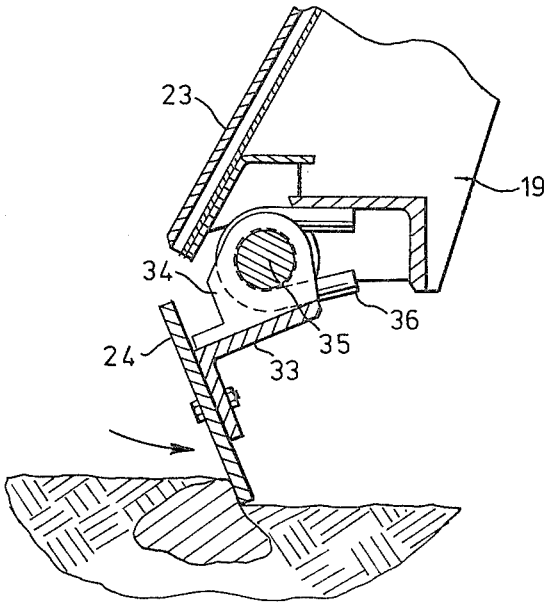
FIG. 4 shows a detail of the structure shown in FIG. 3 but with the scraper blade in a retracted position.
Figure 3:
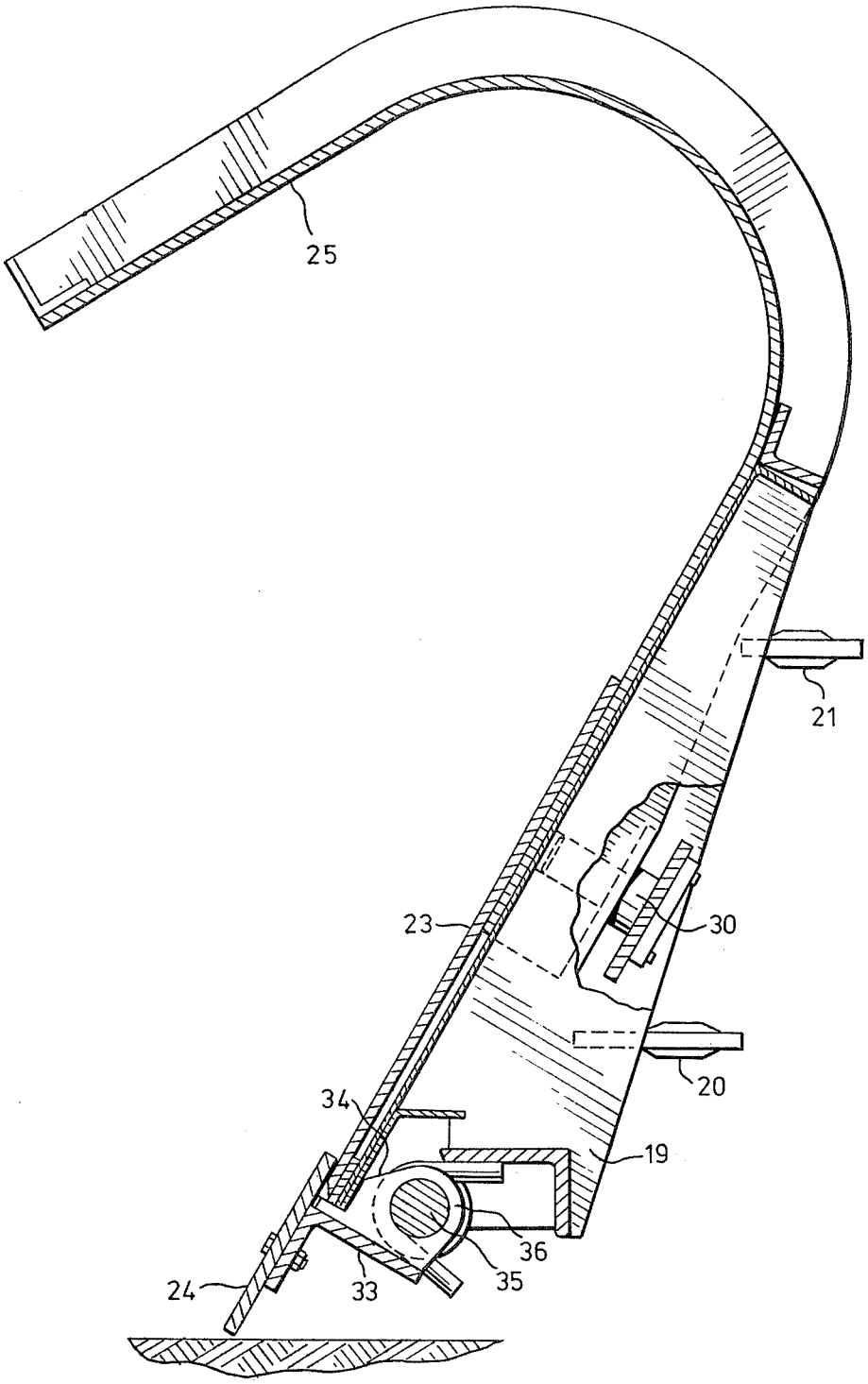
FIG. 3 is a section on line 3—3 in FIG. 2.

As best shown in FIGS. 3 and 4, the scraper blade 24 is pivotally connected to the lower edge of the frame 19 for pivotal movement about a horizontal axis. The connection is made by an angle member 33 bolted to the rear side of the scraper blade and connected by bracket members 34 to horizontal hinge pins 35. The scraper blade is spring-biassed to a forward operative position, as shown in FIG. 3, by a torsion spring 36. However, as illustrated in FIG. 4, the hinge connection enables the scraper blade to be retracted against the bias of the spring 36.

What I claim is:

1. In a snowplow having a forwardly mounted blade configured to scoop snow from the path of the snowplow and cast the snow laterally therefrom, the blade being angled to the forward direction so that during forward movement it scoops snow to slide upwardly and laterally across a front face of the blade towards its trailing end, the blade being pivotally mounted on the plow for pivotal movement about a vertical axis for reversing the direction in which the snow is cast, the improvement in which the blade is a composite structure comprising a lower scoop blade portion having a front face and a deflector portion having a front face positioned to receive snow lifted and sliding along said scoop blade portion, the deflector portion being pivotally mounted on said blade for movement about an axis substantially perpendicular to the front face of the scoop blade portion and tiltable relative to the scoop blade portion about said axis for raising either end with respect to the scoop blade portion and lowering the other end to provide a blade that is flared in the snow discharge direction.

2. A snowplow according to claim 1, including first power means for reversibly rotating the blade about said vertical axis and second power means for reversibly tilting the deflector about said perpendicular axis, the first and second power means being cooperatively coupled so that when either end of the blade is moved to a trailing position the corresponding end of the deflector is moved to the raised position.

3. A snowplow according to claim 1, wherein the scoop blade portion includes a retractable scraper blade biassed by spring means to a normal operative position, the scraper blade being hinged about a transverse axis and being retractable from the operative position against the spring bias.

4. A snowplow attachment for a vehicle having a frontal support therefor, comprising:

a boom structure extending forwardly from the frontal support, a transverse frame pivotally connected to the forward end of the boom structure for pivotal movement about a vertical axis, a composite blade assembly mounted on and extending along the frame, said blade assembly being configured to scoop snow to be cleared from the path of the snowplow and to cast the snow laterally, first power means connected between the transverse frame and the frontal support for turning the frame in either direction about said axis between respective positions in which the opposite ends of the blade assembly are respectively leading and trailing with respect to the forward direction, the blade assembly comprising a fixedly mounted scoop blade portion extending for the full length thereof and a deflector positioned to intercept snow lifted by the scoop blade portion, the deflector being pivotally mounted on the frame for pivotal movement about an axis perpendicular to the scoop blade portion, and second power means connected between the frame and the deflector for tilting the latter about said axis.

5. A snowplow attachment according to claim 4, said frame being connected to the boom structure and said deflector being connected to the frame by respective pivotal connections located midway between the ends of the blade assembly.

6. A snowplow attachment according to claim 5, wherein the first and second power means are cooperatively coupled so that when either end of the blade assembly is moved to a trailing position the corresonding end of the deflector is moved to the raised position.

7. A snowplow attachment according to claim 6, wherein said first and second power means are constituted by respective first and second pairs of hydraulic cylinders, the cylinders of each pair being laterally spaced and disposed on opposite sides of said pivotal connections.

8. A snowplow attachment according to claim 4, wherein the scoop blade portion includes a scraper blade extending along the lower edge of blade assembly, the scraper blade being pivotally connected to the frame and spring-biassed to a normal operative position, the scraper blade being retractable against its bias in response to encounter with an obstruction during forward movement of the snowplow.

* * * * *